United States Patent [19]

Endo et al.

[11] Patent Number: 4,939,549

[45] Date of Patent: Jul. 3, 1990

[54] IMAGE FORMING APPARATUS WITH TEMPERATURE CONTROLLING SHIELD

[75] Inventors: Hideki Endo, Osaka; Noboru Fukuoka, Ohzu; Mitsuharu Okada, Sakai, all of Japan

[73] Assignee: Mita Industrial Co., Ltd., Osaka, Japan

[21] Appl. No.: 378,353

[22] Filed: Jul. 7, 1989

[30] Foreign Application Priority Data

Jul. 11, 1988 [JP] Japan ..... 63-92095[U]

[51] Int. Cl.[5] ..... G03G 15/14; G03G 21/00

[52] U.S. Cl. ..... 355/271; 355/215

[58] Field of Search ..... 355/282, 285, 289, 291, 355/279, 296, 271, 274, 276, 215, 264, 30; 219/201; 98/1

[56] References Cited

U.S. PATENT DOCUMENTS

| | | | |
|---|---|---|---|
| 4,116,556 | 9/1978 | Tanaka et al. | 355/274 |
| 4,315,685 | 2/1982 | Inuzuka et al. | 355/296 |
| 4,575,216 | 3/1986 | Herbert et al. | 355/274 |

FOREIGN PATENT DOCUMENTS

| | | | |
|---|---|---|---|
| 0133747 | 10/1981 | Japan | 355/215 |
| 0218469 | 12/1984 | Japan | 355/215 |
| 0076758 | 5/1985 | Japan | 355/30 |
| 0167959 | 7/1986 | Japan | 355/30 |
| 61-128714 | 8/1986 | Japan . | |

*Primary Examiner*—A. T. Grimley
*Assistant Examiner*—Nestor R. Ramirez
*Attorney, Agent, or Firm*—Armstrong, Nikaido, Marmelstein, Kubovcik & Murray

[57] ABSTRACT

An apparatus for the formation of images comprising a transfer unit for transferring a toner image formed on a photosensitive drum onto a sheet of copy paper, a conveying unit for conveying the copy sheet in a given direction, and a shield for dividing the region below the conveying unit and transfer unit into the upper and lower portions and for shielding the photosensitive drum in the upper portion from the flow of air from the lower portion, thereby providing high quality images.

4 Claims, 2 Drawing Sheets

IMAGE FORMING APPARATUS WITH TEMPERATURE CONTROLLING SHIELD

BACKGROUND OF THE INVENTION

1. Field of the Invention

This invention relates to apparatuses for the formation of images such as electrophotographic copying machines, printers, and the like.

2. Description of the Prior Art

With a conventional apparatus for the formation of images such as an electrophotographic copying machine, an electrostatic latent image formed on a photosensitive drum is developed by a toner, resulting in a toner image. The toner image is then transferred onto a sheet of copy paper by a transfer unit with a corona charger, and the copy sheet with the toner image is further separated from the photosensitive drum by a separating unit with a corona charger, so as to be conveyed to a fixing unit by a conveying unit. The fixing unit fixes the toner image onto the copy sheet.

For the conveying unit to convey the copy sheet with the toner image to the fixing unit, a set of conveyer belts which move in circulation are usually used. Normally, the set of conveyer belts and the separating unit are located so that a space is formed therebetween. When the conveyer belts are operated, ambient air around the belts flows with the circulation of the belts, so that the air may flow through the space toward the photosensitive drum. Moreover, since the conveyer belts are spaced at given spacings in the direction at right angles to the direction of conveyance, there is a possibility that the air may also flow through the spacings toward the photosensitive drum. Furthermore, a shield case of a corona charger serving as a transfer unit or a separating unit is usually formed with an opening for discharging ozone therethrough, so that the air may flow through the opening toward the photosensitive drum.

In the fixing unit which is adjacent to the set of circulating conveyer belts, the toner on the copy sheet is melted by the application of heat and fixed onto the copy sheet with the application of pressure. Because the copy sheet is heated in the fixing unit, water contained in the copy sheet evaporates into ambient air. The hot ambient air containing vaporized water around the fixing unit is moved with the circulation of the conveyer belts, so as to be blown onto the surface of the photosensitive drum through the space between the set of conveyer belts and the separating unit.

In the transfer unit and separating unit, both of which are corona chargers, the corona charge gives rise to a dielectric breakdown in the ambient air, so that the ambient air is ionized, resulting in the formation of ozone. The ozone is also blown onto the surface of the photosensitive drum with the circulation of the conveyer belts.

Thus, with the conventional electrophotographic copying machine, the hot air containing vaporized water and ozone flows upward through the space between the conveyer belts and separating unit and is blown onto the surface of the photosensitive drum.

When ozone is blown onto the surface of the photosensitive drum, there is a possibility that the photosensitivity of the drum is lowered. When the hot air containing vaporized water is blown onto the surface of the photosensitive drum, there is also a possibility that vaporized water, which is contained in the hot air, condenses on the surface of the photosensitive drum, so that a distinct toner image is not formed on the photosensitive drum.

Japanese Laid-Open Utility Model Publication No. 61-128714 discloses an electrophotographic copying machine, in which a heater is disposed below the photosensitive drum in order to prevent condensation on the surface of the photosensitive drum. With this copying machine, condensation of water on the photosensitive drum is prevented by applying heat to the photosensitive drum by means of a heater. However, the copying machine does not prevent the hot air containing water from being blown onto the surface of the photosensitive drum by the circulation of the conveyer belts, so that it is impossible to efficiently prevent condensation on the photosensitive drum. Moreover, it is also impossible to prevent ozone formed by the transfer unit and separating unit from being blown onto the photosensitive drum, so that the deterioration of photosensitivity of the drum cannot be prevented.

In order to overcome the above-mentioned problems, it is possible to propose an electrophotographic copying machine which is provided with an exhaust unit below the transfer unit and separating unit. The exhaust unit forcibly moves the air downward, so that damaging air is not blown onto the photosensitive drum. However, the copying machine provided with an exhaust unit becomes large, and the exhaust unit is not capable of efficiently preventing the flowing of air which occurs in the vicinity of the photosensitive drum with the circulation of the conveyer belts. Moreover, when the photosensitive drum is heated by a heater to prevent condensation on the photosensitive drum, the hot air is exhausted by the exhaust unit, resulting in the decreased efficiency in applying heat to the photosensitive drum.

SUMMARY OF THE INVENTION

The apparatus for the formation of images of the invention, which overcomes the above-discussed and numerous other disadvantages and deficiencies of the prior art, comprises a transfer unit for transferring a toner image formed on a photosensitive drum onto a sheet of copy paper, a conveying unit for conveying the copy sheet in a given direction, and a shield for dividing the region below the conveying unit and transfer unit into the upper and lower portions and for shielding the photosensitive drum in the upper portion from the flow of air from the lower portion.

In a preferred embodiment, the shield is provided with a heater.

In a preferred embodiment, both the top surface and undersurface of said shield are provided with said heaters.

In a preferred embodiment, the heater on the undersurface of the shield is superior to said heater on the top surface of the shield in heat generation characteristics.

Thus, the invention described herein makes possible the objectives of (1) providing an apparatus for the formation of images in which the photosensitive drum is shielded by the shield from the flow of air containing vaporized water and ozone, so that condensation on the photosensitive drum is prevented and that the photosensitivity of the photosensitive drum does not deteriorate, thereby providing high quality images; (2) providing an apparatus for the formation of images in which the photosensitive drum is effectively heated by the heater or heaters provided on the shield which functions as a heat releasing plate, so that the dew condensation on the photosensitive drum is prevented and the photosensitivity of the photosensitive drum is not affected by changes in the temperature thereof; and (3) providing an apparatus for the formation of images in which both the top surface and undersurface of the shield are provided with the heaters with different heat generation characteristics, so that the application of heat to the photosensitive drum by the heaters is controlled with high accuracy.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 2:
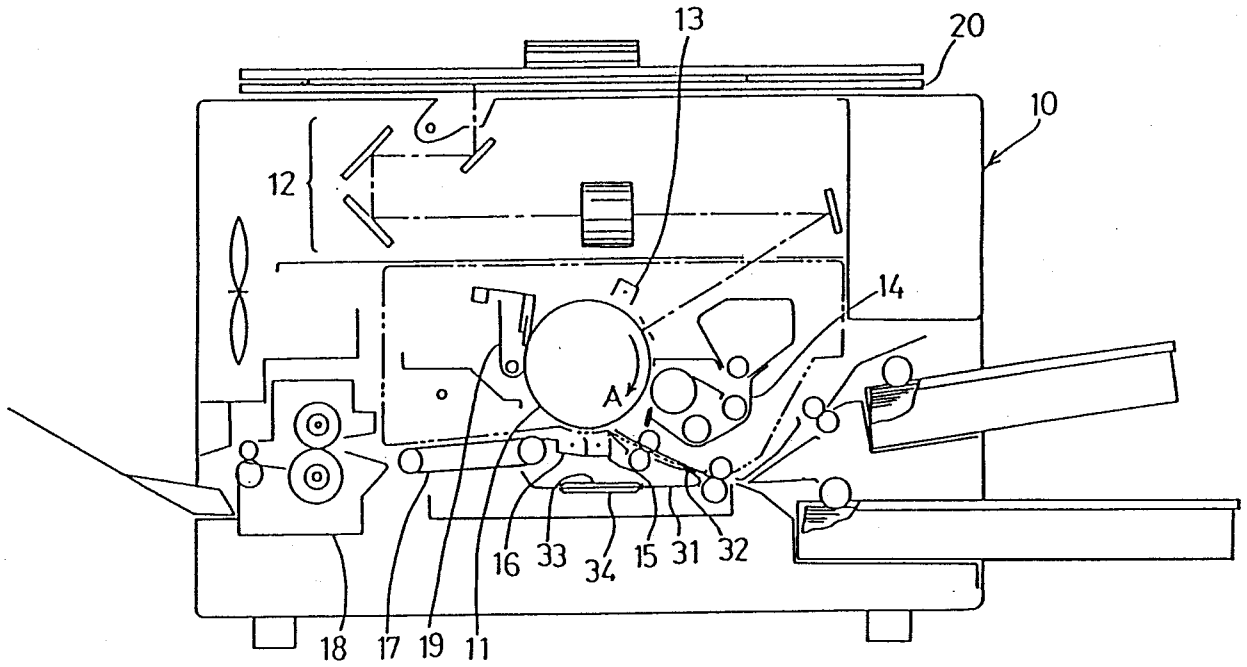
FIG. 2 is a cross sectional view diagrammatically showing the copying machine of FIG. 1.

FIG. 2 shows an electrophotographic copying machine as an example of apparatuses for the formation of images of the invention, which comprises the body 10 of the copying machine, a photosensitive drum 11, an optical means 12, a charging unit 13, a developing unit 14, a transfer unit 15, a separating unit 16, a set of conveyer belts 17, a fixing unit 18, and a cleaning unit 19. The photosensitive drum 11 is positioned in the central portion of the body 10, and is attached to the body 10 in such a manner that it can be rotated in the direction indicated by the arrow A. The optical means 12 is placed above the photosensitive drum 11, and there is an original stand 20 disposed on the top of the body 10. An original, which has been placed in a fixed position of the original stand 20, is irradiated with light from the optical means 12, and the reflected light from the original in turn radiates the photosensitive drum 11.

The charging unit 13 is placed between the optical means 12 and the photosensitive drum 11 so as to face the portion of the photosensitive drum 11 which is upstream of the irradiated portion of the photosensitive drum 11 in the direction of rotation of the photosensitive drum 11, so that the photosensitive drum 11 is uniformly charged by the charging unit 13. When the charged photosensitive drum 11 is irradiated with the reflected light from the original by means of the optical means 12, an electrostatic latent image corresponding to the original image is formed on the photosensitive drum 11.

The developing unit 14 is positioned to face the portion of the photosensitive drum 11 which is downstream of the irradiated portion of the photosensitive drum 11 in the direction of rotation of the photosensitive drum 11. The developing unit 14 develops the electrostatic latent image formed on the photosensitive drum 11 with a toner, resulting in a toner image.

Below the photosensitive drum 11, the transfer unit 15 and the separating unit 16 are disposed side-by-side along the circumference of the photosensitive drum 11. On the other side of the transfer unit 15 opposite to the separating unit 16, a guide 32 is provided so as to guide a sheet of copy paper to the transfer unit 15. The transfer unit 15, which is a corona charger, transfers the toner image on the photosensitive drum 11 onto the copy sheet, and the copy sheet with the toner image is further conveyed to the separating unit 16 which is also a corona charger, where the copy sheet is separated from the photosensitive drum 11.

The conveyer belts 17 are provided at the other side of the separating unit 16 opposite to the transfer unit 15, and conveys the copy sheet that is separated from the photosensitive drum 11 to the fixing unit 18 placed in one side portion of the body 10. The fixing unit 18 melts the toner on the copy sheet with the application of heat and then presses it onto the copy sheet, thereby attaining the fixing of the toner image onto the copy sheet.

After the toner image is transferred onto the copy sheet, any toner remaining on the photosensitive drum 11 is removed by the cleaning unit 19.

Figure 1:
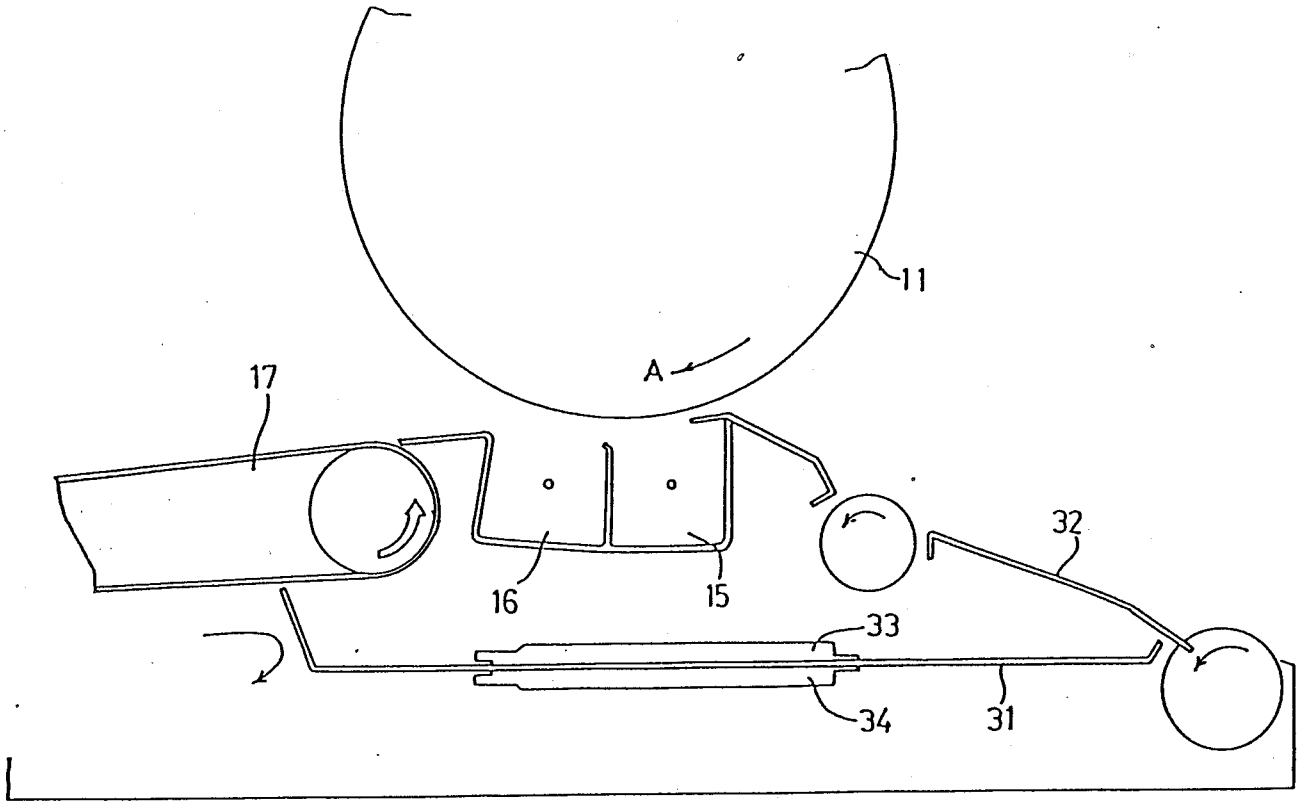
FIG. 1 is an enlarged view showing the principal portion of an electrophotographic copying machine, which is shown as an example of apparatuses for the formation of images of the invention.

FIG. 1 shows a shield 31 in the shape of a plate which is disposed in a substantially horizontal manner below the transfer unit 15 and separating unit 16. One end of the plate-shaped shield 31 is at the vicinity of the guide 32 for guiding the copy sheet to the transfer unit 15 and is bent upward so that its end face is adjacent to one end face of the guide 32. The other end of the shield 31 is at the vicinity of the set of conveyer belts 17 and is bent upward, so that its end face faces the undersurfaces of the circulating conveyer belts 17.

Such a shield 31, which extends from the guide 32 to the set of conveyer belts 17, divides the region below the transfer unit 15 and separating unit 16 into the upper and lower portions. As mentioned above, the other end of the shield 31 is bent and its end face is opposed to the undersurfaces of the conveyer belts 17 in circulation, so that when air flows from the conveyer belts 17 side to the transfer unit 15 side in accordance with the circulation of the conveyer belts 17, the flow of the air is interrupted by the shield 31.

The shield 31 can be a metal plate with excellent thermal conductivity.

Heaters 33 and 34 are respectively attached to the top surface and undersurface of the shield 31. The heater 34 on the undersurface of the shield 31 is superior to the heater 33 on the top surface of the shield 31 in heat generation characteristics, so that the amount of heat generated by the heater 34 is greater than the amount of heat generated by the heater 33.

With the turning on of the main switch of the electrophotographic copying machine, the heater 34 attached to the undersurface of the shield 31 is also turned on, so as to heat the inside of the body 10. Because the heater 34 is excellent in heat generation characteristics and because the shield 31 functions as a heat-releasing plate, the inside of the body 10 is rapidly heated to remove condensation or the like on the surface of the photosensitive drum 11. The heater 34 is placed on the undersurface of the shield 31 which is not opposed to the photosensitive drum 11, so that heat is not directly applied to the photosensitive drum 11 by the heater 34 and that there is no possibility that the photosensitive drum 11 is damaged.

When the photosensitive drum 11 is heated to a given temperature, the heater 34 is turned off while the heater 33 attached to the top face of the shield 31 in turn heats the photosensitive drum 11, thereby preventing condensation on the surface of the photosensitive drum 11. Since the heat generation characteristics of the heater 33 is comparatively poor, there is no danger that the photosensitive drum 11 is damaged even when heat is directly applied to the photosensitive drum 11 by the heater 33.

The formation of images with the electrophotographic copying machine of the invention is carried out by the same procedure as with the conventional electrophotographic copying machine, which is as follows. First, the photosensitive drum 11 which is uniformly charged by the charging unit 13 is irradiated with light and an electrostatic latent image corresponding to an original image is formed on the photosensitive drum 11. The electrostatic latent image is then developed by a toner from the developing unit 14, resulting in a toner image on the photosensitive drum 11. The toner image is transferred onto a sheet of copy paper from the photosensitive drum 11 by the transfer unit 15 which is a corona charger, followed by the separation of the copy sheet from the photosensitive drum 11 by the separating unit 16 which is also a corona charger. The copy sheet, after being separated from the photosensitive drum 11, is conveyed to the fixing unit 18 by the set of conveyer belts 17, where the toner image is fixed onto the copy sheet by the fixing unit 18.

In reproducing images, the conveyer belts 17 move in circulation for conveying the copy sheet, and ambient air around the conveyer belts 17 flows with the circulation of the conveyer belts 17. However, the flow of air is interrupted by the shield 31, so that there is no danger that air will flow toward the photosensitive drum 11 through the space between the set of conveyer belts 17 and the separating unit 16. Consequently, there is no possibility for ozone resulting from corona charge by the transfer unit 15 and the separating unit 16 as well as hot air containing water from the fixing unit 18 to be blown onto the surface of the photosensitive drum 11.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus for the formation of images comprising a transfer unit for transferring a toner image formed on a photosensitive drum onto a sheet of copy paper, a conveying belt disposed adjacent to the transfer unit for conveying the copy sheet in a given direction, and a shield having a part which is located in a region where air flow is generated from below the upstream end of the conveying belt by the movement thereof, said shield interrupting said air flow and being located so as to cover the entire region below the transfer unit, dividing said entire region into upper and lower portion.

2. An apparatus for the formation of images according to claim 1, wherein said shield is provided with a heater.

3. An apparatus for the formation of images according to claim 2, wherein both the top surface and undersurface of said shield are provided with said heaters.

4. An apparatus for the formation of images according to claim 3, wherein said heater on the undersurface of the shield is superior to said heater on the top surface of the shield in heat generation characteristics.

* * * * *